US006299486B1

(12) United States Patent
Morikawa et al.

(10) Patent No.: US 6,299,486 B1
(45) Date of Patent: Oct. 9, 2001

(54) CONNECTOR PLUG

(75) Inventors: Seiichi Morikawa; Naoyuki Ono, both of Tokyo (JP)

(73) Assignees: Sony Corporation; SMK Co., Ltd., both of Tokyo (JP)

( * ) Notice: Subject to any disclaimer, the term of this patent is extended or adjusted under 35 U.S.C. 154(b) by 0 days.

(21) Appl. No.: 09/457,526

(22) Filed: Dec. 9, 1999

Related U.S. Application Data

(63) Continuation of application No. 08/981,067, filed as application No. PCT/JP96/01188 on Apr. 30, 1996, now Pat. No. 6,024,606.

(30) Foreign Application Priority Data

Jun. 12, 1995 (JP) ..... 7-167883

(51) Int. Cl.[7] ..... H01R 9/03
(52) U.S. Cl. ..... 439/610; 439/607
(58) Field of Search ..... 439/610, 680, 439/607, 608, 609

(56) References Cited

U.S. PATENT DOCUMENTS

| | | | | |
|---|---|---|---|---|
| 5,041,020 | | 8/1991 | Michael . | |
| 5,338,227 | * | 8/1994 | Nakamura | 439/607 |
| 5,622,522 | * | 4/1997 | Tan et al. | 439/607 |
| 5,788,537 | * | 8/1998 | Davis et al. | 439/607 |
| 6,039,606 | * | 3/2000 | Chiou | 439/607 |

FOREIGN PATENT DOCUMENTS

| | | |
|---|---|---|
| 58-139686 | 9/1983 | (JP) . |
| 59-192282 | 12/1984 | (JP) . |
| 63-172069 | 11/1988 | (JP) . |

OTHER PUBLICATIONS

"P1394a Draft Standard for a High Performance Serial Bus (Supplement)", IEEE; P1394a Draft 2.0, Mar. 15, 1998, pp. 25–31.

"Cable Connector with Integral Grounding Feature", E.C. Uberbacher, IBM Technical Disclosure Bulletin, vol. 23, No. 9, Feb. 1981, pp. 4242–4243.

* cited by examiner

*Primary Examiner*—Paula Bradley
*Assistant Examiner*—Larisa Tsukerman
(74) *Attorney, Agent, or Firm*—McDermott, Will & Emery

(57) ABSTRACT

In a connector plug covering the housing (78) with contacts (82) in the socket engaging hole (81) by the metal shell portion (88) of the shield case (79), the metal shell portion (88) is roughly angular cylindrical in the direction of insertion of a plug, by installing the elasticity portion (77) bulged out to this roughly angular and cylindrical both-side portion (88) or bent to curve outwards the lower part of the roughly angular cylindrical both-side portion, and forms in the direction of insertion of a plug the gap (89) to let have flexibility to the metal shell portion (88) in the bottom. And then if the connector plug (41) is inserted into the connector socket (42), by the elasticity portion (77) of the metal shell portion(88), the metal shell portion (88) has flexibility as a whole, the escape when the metal shell portion (88) is pressed in to the inner part, is absorbed, the metal shell portion (88) is surely stuck and connected to the connector socket (42), and the overall structure comes to be compact.

7 Claims, 7 Drawing Sheets

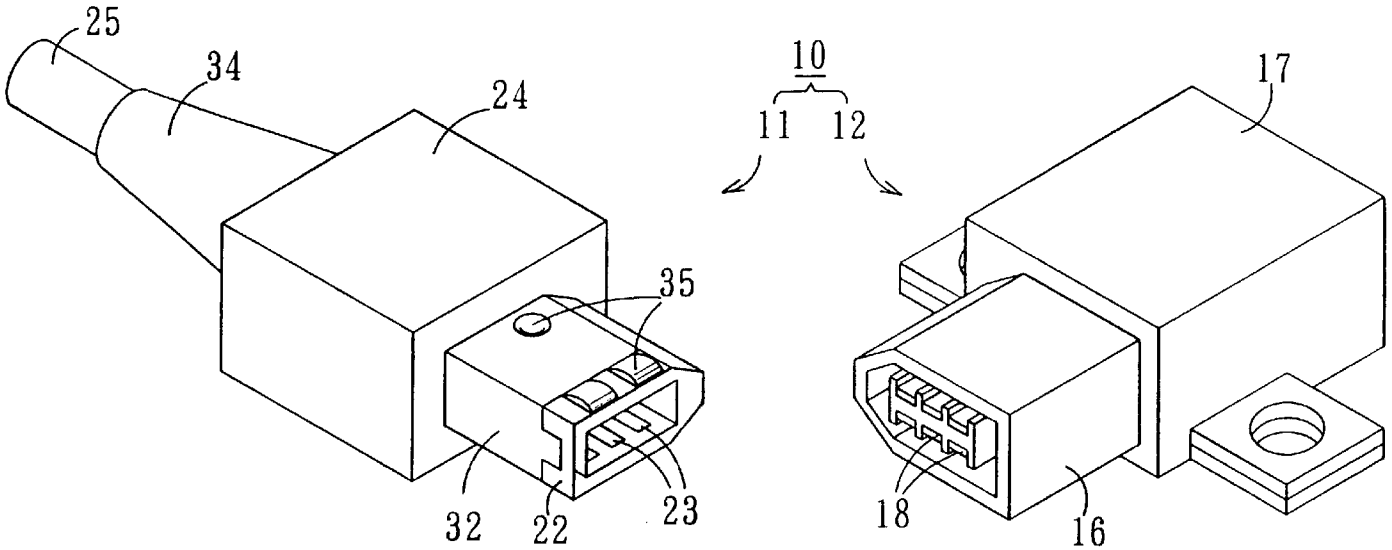
Fig. 7 (a) PRIOR ART
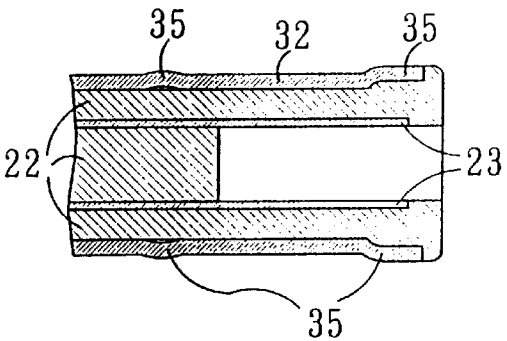
Fig. 7 (b) PRIOR ART

CONNECTOR PLUG

This application is a continuation of application Ser. No. 08/981,067 filed Dec. 10, 1997, now U.S. Pat. No. 6,024,606 which is a 371 application of PCT/JP96/01188, filed Apr. 30, 1996.

TECHNOLOGY FIELD

The present invention relates to a connector plug suitable for the transmission of digital signals when a VTR, TV, CD player, tuner, amplifier, etc. require interconnection with one another.

BACKGROUND TECHNOLOGY

In general, a connector 10 is, as shown in FIG. 7(*a*), composed of a connector socket 12 which is adapted for connection to a chassis, and the connector plug 11, which is connected at the end of a cable 25.

The above-mentioned connector plug 11 has a plurality contacts 23 on the inside of the open front of a housing 22, and has the outer periphery of this housing 22 covered with a shaped metal shell 32. The plural contacts 23 are connected to either a signal conductor or a power line contained in the cable 25. This connecting portion is enclosed within a cover 24.

Conventionally, to ensure a good contact when fitting the connector plug 11 into the connector socket 12, as shown in FIG. 7 (*b*), a projection or "bulging-out" portion 35 which is resiliently springy, is formed both in the tip portion and the central portion of both the top and bottom faces of the metal shell 32, respectively.

This conventional connector plug 11 is designed to held in the connector socket 12 only by these bulging-out portions 35. However, even though it is desired to install the bulging-out portion 35 of sufficient shape to function as a spring with respect to the angular cylindrical metal shell 32, under the circumstances wherein downsizing is demanded, there is a dimensional restriction resulting in a problem that adequate spring properties cannot be obtained.

Therefore, the present invention is aimed at offering a connector plug in which adequate spring properties can be obtained with almost no change in the shape of the conventional metal shell.

Additionally, the present invention is aimed at offering a connector plug wherein the construction as a whole is compact, and the metal shell portion is securely retained in the connector socket.

DISCLOSURE OF THE INVENTION

The present invention is, as shown in FIG. 1 and FIG. 3, a connector plug which features a housing 78 with plural contacts 82 in a socket engagement opening or hole 81, and which is covered with a metal shell portion 88 composed of a conductive metal plate and which forms a shield case 79. The metal shell portion 88 has an essentially hollow rectangular configuration, and includes a resilient or elastic portion 77 which extends out on both sides. This endows flexibility along both of the lower sides and forms a gap which extends along the length of the metal shell portion.

When inserting a connector plug 41 into a connector socket 42, the elasticity of portion 77 of the metal shell portion 88, renders the metal shell portion 88 as a whole flexible, and when the metal shell portion 88 is pushed into the interior of a connector socket 42, the distortion is absorbed by the gap 89, and the metal shell portion 88 is securely retained in the connector socket 42.

In addition to this, since the metal shell 88 is flexible, an elastic portion of the natured used in the conventional arrangement is not required, and the whole construction becomes simpler and more compact.

BRIEF DESCRIPTION OF THE DRAWINGS

FIG. 3(*b*) is a cross-sectional view showing a second embodiment of the elasticity portion 7 provided in the metal shell portion 88.

FIG. 6(*b*) is a side view of the cable 25.

FIG. 6(*c*) is a cross-sectional view showing different examples of the cable 25 depicted in FIG. 6(*a*).

FIG. 7(*a*) is a perspective view of conventional connector plug and connector socket, and FIG. 7(*b*) is a cross-sectional view of tip part of the connector plug shown in FIG. 7(*a*).

PREFERRED EMBODIMENT OF THE INVENTION

An embodiment of the present invention is explained with reference to FIG. 1 through FIG. 6.

Figure 2:
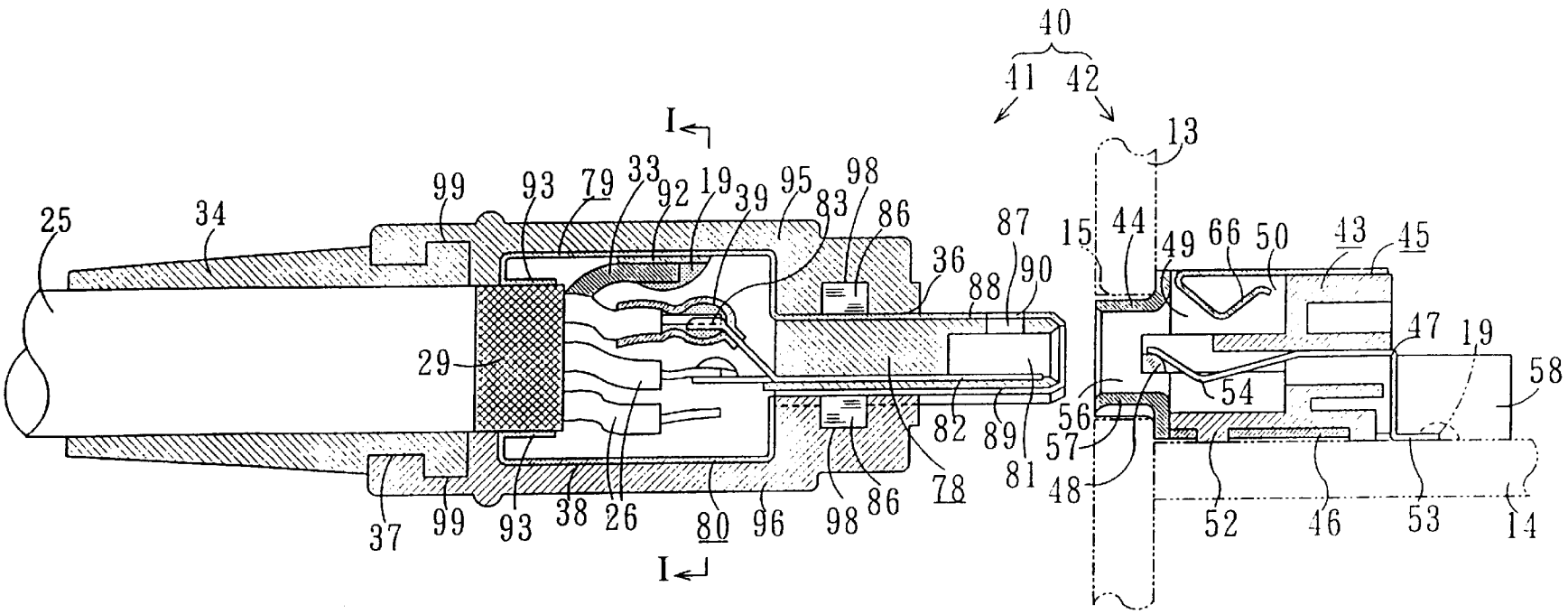
FIG. 2 is a cross-sectional view of the connector plug and connector socket according to the present invention.

In FIG. 2, the numeral 40 denotes a connector according to the present invention. As shown, this connector 40 consists of a connector plug 41 and a connector socket 42.

Figure 1:
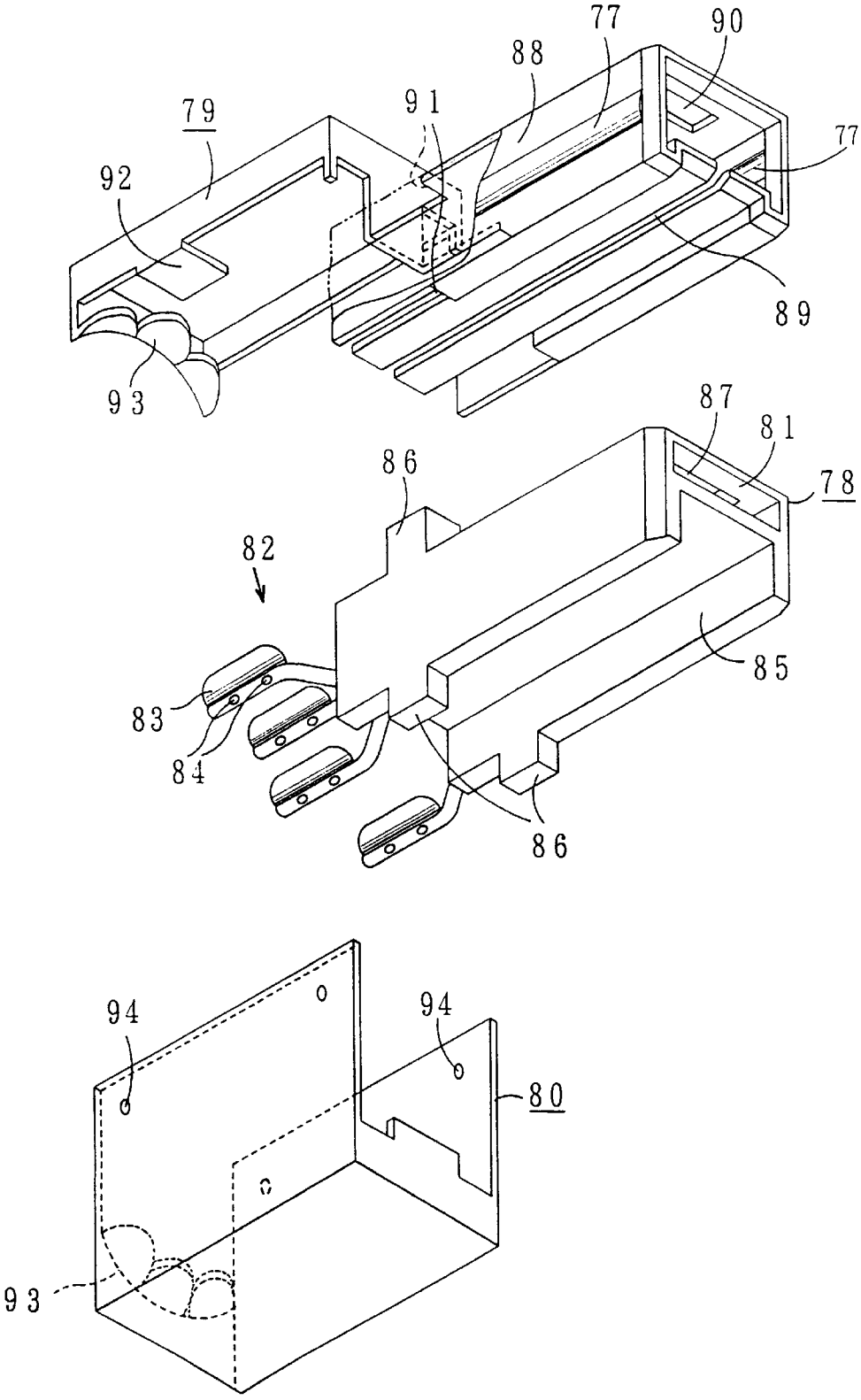
FIG. 1 is an exploded perspective view showing an embodiment of the connector plug according to the present invention.
Figure 5:
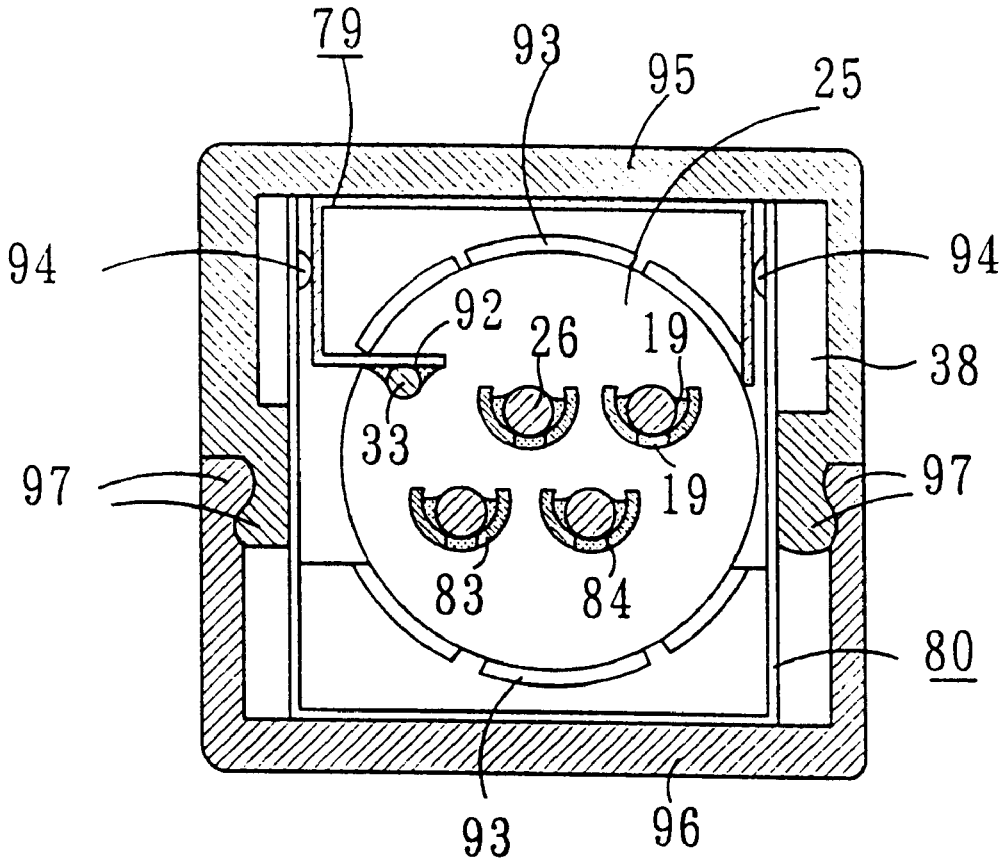
FIG. 5 is a cross-sectional view taken along the A—A line of FIG. 2.

The connector plug 41 includes a housing 78 made of insulating resin, an upper shield case 79 composed of a conductive metal plate, a lower shield case 80 composed of a conductive metal plate in the same way as shown in the exploded perspective view of FIG. 1, an upper cover 95 made of insulating resin, and a lower cover 96 made of insulating resin in the manner shown in FIG. 2 and FIG. 5.

The housing 78 has an open socket 81 in the front, a longitudinally extending bottom groove 85 on the bottom face, a half lock hole 87 formed through the top face, projection preventing portions 86 which extend vertically up at a rear edge, and a chamfering at the front end.

Additionally, the housing 78 is integrally molded with plural contracts 82. One end of these contacts 82 mates with the socket 81, while the other ends of the contacts 82 protrude rearwardly. A terminal portion 83 is formed at the rearward end of each of the contacts 82. This terminal portion 83 is, as shown in FIG. 5, semi-cylindrical with a somewhat larger diameter than a signal conductor 26 to be connected. Further, in the bottom of this terminal portion 83, a small hole 84 which is sized to permit molten solder 19 to spontaneously flows in but not out, is provided.

More specifically, assuming the diameter of the signal conductor 26 is 0.3 mm, the diameter of the semicircular portion of the terminal portion 83 is 1.0 mm more or less, and the diameter of the small hole 84 is about 0.3 mm. Since this terminal portion 83 has small adjacent spaces, it is desirable to arrange them in an alternately and vertically zigzag configuration.

The upper shield case 79 forms the metal shell portion 88 as a whole in the front end. Since this metal shell portion 88 is inserted into the housing 78 from the rear, the whole arrangement is essentially rectangular. The bottom is folded to match the bottom groove 85, and provided with a gap 89 which is unique to the present invention and which extends along the length of shell portion to endow elasticity thereon.

Figure 3:
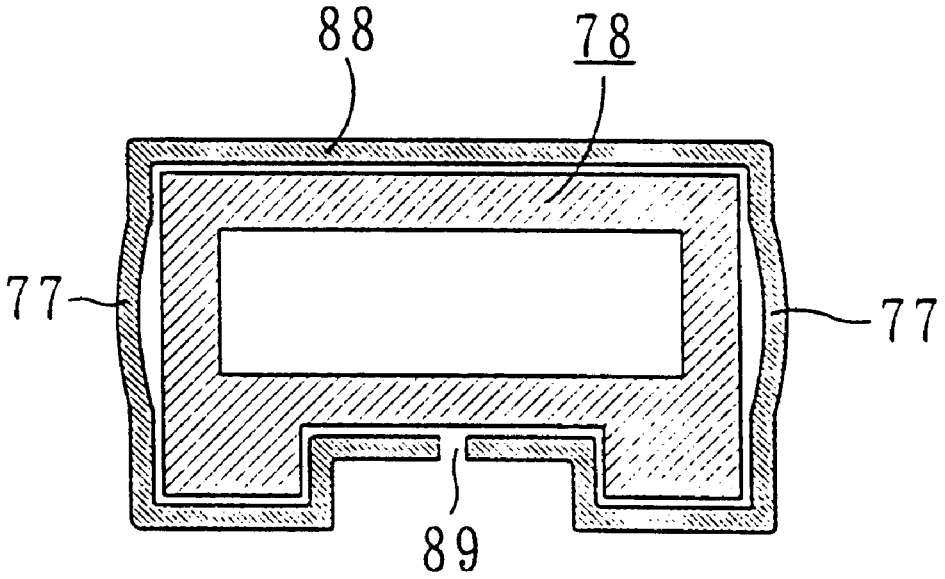
FIG. 3(*a*) is a cross-sectional view showing a first embodiment of the elasticity portion 77 provided in the metal shell portion 88.
Figure 3:
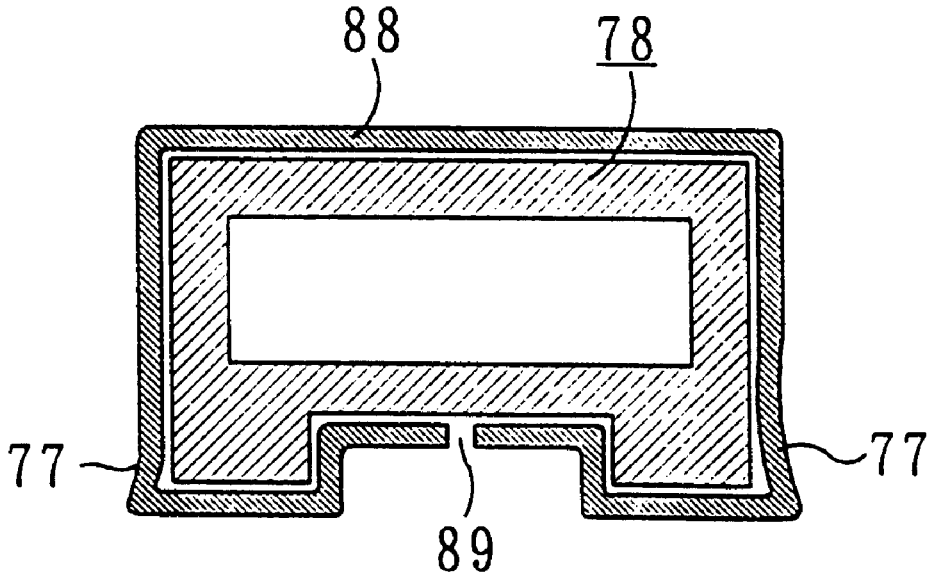

More specifically, as shown in FIG. 3(*a*), the elasticity portions 77 that bulge out on both sides of the metal shell portion 88 are each arranged to extend in the longitudinal direction. Alternatively, as shown in FIG. 3(*b*), the elasticity portion 77 can be formed by an outwardly extending bend portions which are formed along the lower part of both sides of the metal shell portion 88 and which extend in the longitudinal direction of the shell. Accordingly, if this metal shell portion 88 is engaged with the connector socket 12, the metal shell portion 88 as a whole, is pressed inwardly and engaged with a portion 56 of the shield case 44 through the elastic deformation of the elasticity portion 77. At this time, the gap 89 serves as recess.

In the upper plate of the metal shell portion 88, a half lock hole 90 is drilled, and both the upper plate and the lower plate are provided with notch portions 91 through which the projections 86 can extend.

In the back end of the upper shield case 79, is a shallow lid type of arrangement defined by the upper plate and side plates. This lid arrangement has integral semicircular portions 93 which extend inwardly from the lower end. A side plate connecting terminal portion 92 is folded inwardly from a side wall in the illustrated manner.

The lower shield case 80 forms a box without a lid and has a bottom plate and four side walls. Similarly to the upper shield 79 this structure has integrally formed semicircular portions 93 folded inwardly from the rear wall. The side are rear walls are formed with a plurality of inwardly protruding portions 94 which are formed to assure contact with the upper shield case 79.

The upper cover 95 and the lower cover 96 are, as shown in FIG. 2 and FIG. 3, of such shapes as to define an essentially rectangular prism when mutually engaged, form engaging portions 97 which mate on both sides, respectively, form an angular hole 36 in the front and a round hole 37 in the back, form a hollow portion 38 inside, and further form an engaging groove 98 and an engaging groove 99, respectively, on the internal wall of the angular hole 36 and the round hole 37.

The order of assembly of the above parts is now explained.

Figure 6:
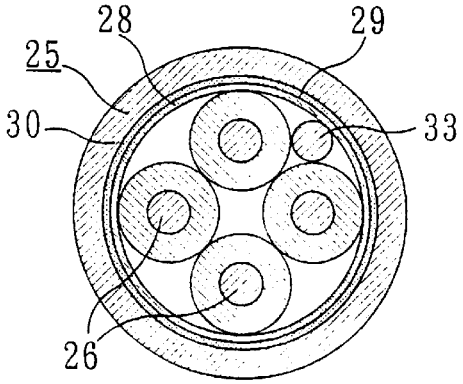
FIG. 6(*a*) is a cross-sectional view of the cable 25.
Figure 6:
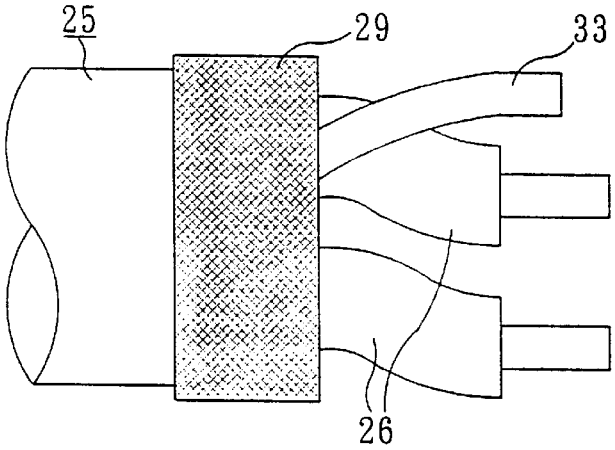
Figure 6:
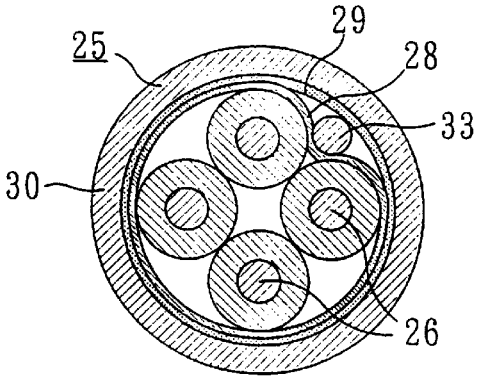

First, as shown in FIG. 2 and FIG. 6, the cable 25 is installed in a bush 34, the signal conductors 26 and a grounding wire 33 are exposed, a shield 29 is folded back about the external circumference of an insulating jacket 30, and an insulating tube 39 is fitted over the ends of the signal conductors 26. A grounding cable 33 is inserted between the conductive tape 28 and the signal conductors 26 as shown in FIG. 6(*a*) or inserted between the shield 29 and the conductive tape 28 as shown in FIG. 6(*c*).

Next, the signal conductors 26 are placed one by one onto the terminal portions 83 of the contacts 82, and connected with solder 19. At this time, it should be confirmed from the bottom face of the terminal portion 83 whether solder 19 has flown into the small hole 84. If connected, the insulating tube 39 is shifted over the connection part and heated, the insulating tube 39 is thermally shrunken, and stuck to the signal conductor 26 and/or the terminal portion 83, protecting from short-circuit or disconnection.

The housing 78 connected with the signal conductor 26, is inserted from the back edge into the metal shell portion 88 of the upper shield case 79, and pressed in until the slip-out protruded portions 86 are properly received in the notch portions 91. Then, the grounding wire 33 is connected to the connecting terminal portion 92 with solder 19.

Next, the lower shield case 80 is engaged with the upper shield case 79. At this time, the shield 29, which is folded back over the outside of the insulating jacket 30, is contacted with the semicircular portions 93 of the upper shield case 79 and the semicircular portions 93 of the lower shield case 80, as well the protruded portion 94 of the lower shield case 80, are connected by pressure to the side plate of the upper shield case 79. The upper cover 95 is disposed over the upper shield case 79, upper and lower engaging portions 97 are fitted into and engaged by disposing the upper cover 95 on the upper shield case 79 and disposing the lower cover 96 over the lower shield case 80. At this time, the slip-out protruded portions 86 become engaged with the engaging groove 98, the upper shield case 79 and the lower shield case 80 are engaged with the hollow portion 38, the leading end portion of the bush 34 is engaged with the engaging groove 99, the leading end portion of the metal shell portion 88 is protruded from the angular hole 36, and the assembling of the connector plug 41 is completed.

Figure 4:
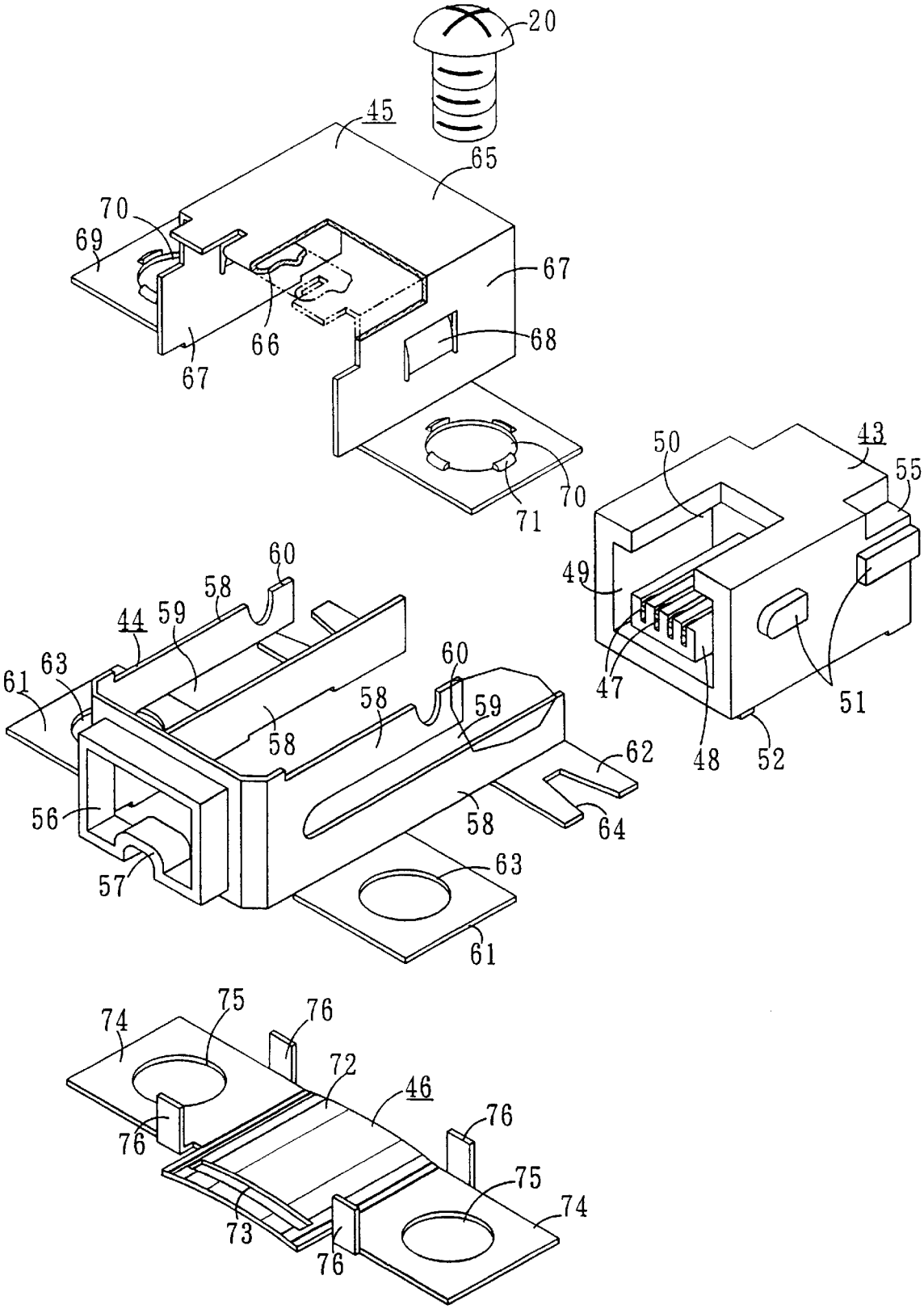
FIG. 4 is an exploded perspective view of connector socket shown in FIG. 2.

Next, details of the connector socket 42 are explained with reference to FIGS. 2 and 4.

This connector socket 42 consists of a housing 43 made of insulating resin, a shield case 44 made of conductive metal plate, a shield upper lid 45 made of conductive metal plate, and a shield base plate 46 made of conductive metal plate.

The housing 43 has a terminal receiving portion 48 which engages the connector plug 41 at the front opening portion 49 side and a plurality of terminals 47 at disposed at regular intervals on this terminal receiving portion 48. The leading edge of each terminal 47 is somewhat protruded downwardly with respect to the terminal receiving portion 48, thus forming a contact portion 54. The other end of the terminals 47 is are each protruded from the back portion of the housing 43, resulting in a terminal portion 53.

In the upper plate part of this housing 43, a top face notch portion 50 is formed from the front edge, in the side plate portion 2 two mating portions 51 are horizontally formed with gap for an engaging hook 68 described later, and, in the rear rectangular section, an engaging concave portion 55 is formed, and in the bottom, an arrangement determining protrusion portion 52 is formed.

The shield case 44 forms the engaging portion 56 in the center by the press process of conductive metal plate, and the bottom of this engaging portion 56 is formed with push-in direction determining protrusion 57 in the bottom of this engaging portion 56. A side plate portion 58 is folded and formed backwards from both sides of this engaging portion 56, a slit 59 is formed from the back edge in this side plate portion 58, a tongue piece 60 is formed at the back upper edge of this side plate portion 58. Further, a screw fastening piece 61 and a fixing piece 62 are folded outward and formed in the bottom of thee plate portion 58, in the screw fastening piece 61, a screw hole 63 is formed, and in the fixing piece 62, a V-shaped notch portion 64 is formed.

The shield upper lid 45 is formed by folding a U-shaped form which is open at the bottom using conductive metal plate, folding the front edge part of a top face portion 65 at about 180 degrees back inside, thus integrally forming the half lock piece 66. This is then followed by cutting, raising and forming an engaging hook 68 on both sides. This is then followed by the formation of screw fastening piece 69 which are folded outward from the bottoms of each side plate portion 67. In this screw fastening piece 69, a screw hole 70 is drilled, and for improvement in reliability at screw fastening, plural protruded portions 71 are unitarily formed around the screw hole 70.

The shield base plate 46 is composed of a long narrow conductive metal plate, the central bottom part 72 of which is concave, includes a positioning slot 73. Screw holes 75 are formed in screw fastening pieces 74 which are located at each end of the base plate and clinching pieces 76 between the concave bottom 72 and the screw fastening piece 74 and are such as to protrude upwards.

Next, the assembling order of the connector socket 42 is explained.

The housing 43 is engaged in such a way that the mating projections 51 are guided into the slits 59 from the rear of the shield case 44, and after engagement, is fixed by folding the tongue piece 60 against the sides of the engaging concave portions 55. At this time, the terminal receiving portion 48 is located facing the front of the engaging portion 56.

Next, the shield upper lid 45 is disposed over the shield case 44. Then, the side plate portion 67 of the shield upper lid 45 is engaged by sliding it over the outside of the side plate portion 58 of the shield case 44, until the engaging hooks 68 engage the convex mating portions 51 which are received in the slits 59. At this time the half lock piece 66 is freely received in the notch portion 50 of the housing 43, so as to be oppose the upper part of the terminal receiving portion 48, as well make the screw hole 63 and the screw hole 70 align, and so that the screw fastening pieces 61 and the screw fastening pieces 69 overlap.

Next, the shield base plate 46 is applied in such a way that the positioning hole 73 and the arrangement determining protrusions 52 are fitted against the bottom face of the housing 43. Following this, the screw hole 75 of one of the screw fastening pieces 74 is aligned, and the 3 pieces 74, 61 and 69 are connected by folding over the clinching piece 76 on one side.

Next, if the screw fastening piece 74 of the other side is pressed against the corresponding screw fastening piece 61, the bottom of the housing 43 is pressed against concave bottom 72, and the top face of the housing 43 is pressed against the inner face of the top face portion 65 of the shield upper lid 45. By the folding the clinching pieces 76 in this state, the three pieces 74, 61 and 69 are connected together.

The connector socket 42 thus assembled, is fitted into position with respect to a through hole in a chassis and thus is located with respect to a wiring plate and is secured in placed by screws 20. The wiring plate is then fixed to the fixing piece 62 with solder 19. Further, the terminal portion 53 of the terminal 47 is connected with solder.

If the connector plug 41 constituted as above is inserted into the connector socket 42, the metal shell portion 88 of the upper shield case 79 fits against the engaging portion 56 of the shield case 44. At this time, it is inserted in such a way that the bottom groove 85 and the protruded portion 57 mate, and there is no way that insertion of the connector plug could occur if it were inverted.

When inserting the metal shell portion 88 into the engaging portion 56, due to the elasticity portion 77, the whole metal shell portion 88 exhibits elasticity, and the displacement is absorbed by the gap 89, and the metal shell portion 88 and the engaging portion 56 are snugly engaged with one another.

If the metal shell portion 88 is inserted more, the contact 82 is contacted with the contact portion 54 of the terminal 47, and connected electrically. In addition to this the half lock piece 66 of the shield upper lid 45 become engaged with the half lock hole 90 of the metal shell portion 88 and the half block hole 87 of the housing 78, the connector plug 41 is half locked to the connector socket 42.

When extracting the connector plug 41 from the connector socket 42, even through an external force is added to the direction intersecting with the inserting direction to the connector plug 41, the connector socket 42 is not only fixed by the screw 20, but also fixed by the fixing piece 62 of the shield case 44, thereby withstanding use for a long period without being torn free from the terminal portion 53 of the terminal 47.

Since the metal shell portion 88 of the present invention has a rectangular prism shape, the gap 89 is able to endow flexibility on the metal shell portion 88 proper along its length, and no elasticity portion like conventional protruded portion, etc. is required, and the overall construction is made compact.

In addition to this, since the metal shell portion 88 is essentially rectangular in configuration, by providing the elasticity portions 77 which bulge out on both sides, during installation the elasticity portions 77 which curve outward from the lower part of the essentially rectangular are such as to, in combination with the gap 89 that provides elasticity along the length of the shell portion, permit the connector plug 41 proper flexibility, and to permit the distortion to be absorbed by the gap 89, whereby the metal shell portion 88 is surely engaged against the connector socket 42.

INDUSTRIAL UTILIZATION POSSIBILITY

As mentioned above, in case a VTR, TV, CD player, tuner, amplifier, etc. are mutually connected by using a connector plug and a connector socket, the connector plug related to the present invention is adequate to use mainly in the transmission of digital signals.

What is claimed is:

1. A connector plug comprising:

a housing contacts; and a metal shell which encloses said housing and which has:
- an upper wall portion,
- a lower wall portion which has a width which is greater than that of the upper wall portion, and
- side wall portions which integrally connect the upper wall portion and the lower wall portion, wherein said housing and said metal shall respectively having a channel-like indentation portion which has side walls and a contiguous base wall, the channel-like indentation portion which is formed in the metal shell having a gap which extends longitudinally along the base wall portion thereof, and said channel-like indentation portion is formed in the lower wall portion of said metal shell.

2. A connector plug as set forth in claim 1, wherein the upper wall portion of said metal shell has a hole formed therein.

3. A connector plug comprising:

a housing contacts; and a metal shell which encloses said housing and which has:
- an upper wall portion, a lower wall portion which has a width which is greater than that of the upper wall portion, and side wall portions which integrally connect the upper wall portion and the lower wall portion, wherein said housing and said metal shall respectively having a channel-like indentation portion which has side walls and a contiguous base wall, the channel-like indentation portion which is formed in the metal shell having a gap which extends longitudinally along the base wall portion thereof, and the upper wall portion is essentially flat and the lower wall portions on either side of the gap are essentially flat and essentially parallel to the essentially flat upper wall portion.

4. A connector lug comprising:

a housing contacts; and a metal shell which encloses said housing and which has: an upper wall portion, a lower wall portion which has a width which is greater than that of the upper wall portion, and side wall portions which integrally connect the upper wall portion and the lower wall portion, wherein said housing and said metal shall respectively having a channel-like indentation portion which has side walls and a contiguous base wall, the channel-like indentation portion which is formed in the metal shell having a gap which extends longitudinally along the base wall portion thereof, and the upper wall portion of the metal shell is formed with a half lock opening which is so sized and disposed as to receive a resilient projection portion forming part of a connector socket into which the connector plug is insertable.

5. A connector plug comprising:

a housing contacts; and a metal shell which encloses said housing and which has: an upper wall portion, a lower wall portion which has a width which is greater than that of the upper wall portion, and side wall portions which integrally connect the upper wall portion and the lower wall portion, wherein said housing and said metal shall respectively having a channel-like indentation portion which has side walls and a contiguous base wall, the channel-like indentation portion which is formed in the metal shell having a gap which extends longitudinally along the base wall portion thereof, and the upper wall portion of the metal shell is formed with a half lock opening which locationally coincides with a half lock hole formed in the housing, the half lock opening and half lock hole being so sized and disposed as to receive a resilient projection portion forming part of a connector socket into which the connector plug is insertable.

6. A connector plug comprising:

a housing having contacts; and a metal shell which encloses said housing and which has: an essentially flat upper wall portion, a lower wall portion which has a width which is greater than that of the upper wall portion, a gap which extends along the lower wall portion with the lower wall portions on either side of the gap being essentially flat, and side wall portions which integrally connect the upper wall portion and the lower wall portion, the side wall portions merging with the upper wall at about 90° and merging with the lower wall via outwardly extending curved portions.

7. A connector plug comprising:

a housing having a rectangular cross-sectional portion in which a channel-like recess is formed longitudinally along a lower surface thereof, the channel-like recess having side walls and a bottom wall;

a shield case in the form of a metal sheet wrapped about the rectangular cross-sectional portion of the housing so that edge portions of the metal sheet juxtapose one another in the channel-like recess in a manner to define a gap therebetween, and so that the shield case has an essentially flat upper wall and essentially flat lower wall portions located on either side of the channel-like recess; and projections formed on opposite wall portions of the shield case which extend in opposite directions from respective outboard edges of the lower wall portions.

* * * * *